US005971151A

United States Patent [19]

Tanaka

[11] Patent Number: 5,971,151

[45] Date of Patent: Oct. 26, 1999

[54] COMBINED HOLDER FOR DISPLAYING AND PACKAGING MIDGET LAMP ASSEMBLY

[76] Inventor: Hisayuki Tanaka, 3-34, Hisagi 2-chome, Zushi-shi, Kanagawa-ken 249, Japan

[21] Appl. No.: 09/003,797

[22] Filed: Jan. 7, 1998

Related U.S. Application Data

[63] Continuation of application No. 08/739,116, Oct. 25, 1996, abandoned.

[30] Foreign Application Priority Data

Nov. 27, 1995 [JP] Japan ..... P7-332809

[51] Int. Cl.[6] ..... B65D 73/00; B65D 85/42

[52] U.S. Cl. ..... 206/419; 206/420; 206/421; 206/418; 206/477; 206/485

[58] Field of Search ..... 206/420, 421, 206/422, 418, 461, 477, 481, 485, 419

[56] References Cited

U.S. PATENT DOCUMENTS

| | | | |
|---|---|---|---|
| 1,981,731 | 11/1934 | Holy | 206/419 |
| 5,168,999 | 12/1992 | Lee et al. | 206/420 |
| 5,317,491 | 5/1994 | Lee | 206/420 |
| 5,597,070 | 1/1997 | Wu | 206/419 |

FOREIGN PATENT DOCUMENTS

| | | | |
|---|---|---|---|
| 2006304 | 4/1969 | France | 206/419 |
| 463668 | 5/1951 | Italy | 206/485 |
| 270720 | 12/1950 | Switzerland | 206/485 |

*Primary Examiner*—David T. Fidei
*Assistant Examiner*—Anthony Stashick
*Attorney, Agent, or Firm*—Trexler, Bushnell, Giangiorgi & Blackstone, Ltd.

[57] ABSTRACT

A combined holder for displaying and packaging a decorative midget lamp assembly, which can be satisfied with beauty of concentrative random twinkling and flickering of the plurality of light sources displacing toward left and right generating from on-off controlling operation of the light sources, the holder can effectively use a cover portion formed in the package condition where the portion of the power cable occupying approximately 80% of space in the overall decorative midget lamp assembly is hidden, as a space for displaying a fantastic picture, and the holder can also ornament it on a tree or other structures after taking out it from the holder as usual. The combined holder comprises a central stage zone 4 in which a plurality of midget light sources 1 are concentratively arranged in double strings; and a pair of cover portions 5, 7 being placed at an upper portion and a lower portion of said central stage zone 4, said portions in which a power cable 3 connecting said plurality of midget light source 1 in series, and connecting parts 2 thereof are received with division in half amount each.

5 Claims, 7 Drawing Sheets

COMBINED HOLDER FOR DISPLAYING AND PACKAGING MIDGET LAMP ASSEMBLY

This application is a continuing application based upon U.S. application Ser. No. 08/739,116, filed Oct. 25, 1996, now abandoned which in turn claimed priority of Japanese Application No. P7-332809, filed Nov. 27, 1995. Priority under the United States patent law is claimed with respect to the above-noted prior U.S. application and the Japanese application under the provisions of 35 USC 119 and 35 USC 120.

BACKGROUND OF THE INVENTION

1. Field of the Invention

The present invention relates to a combined holder for displaying and packaging a decorative midget lamp assembly, and more particularly relates to a holder in which a midget lamp assembly is packaged with a display such that a consumer can be fascinated by the random twinkling and flickering of light sources generating from on-off controlling operation of a plurality of the midget lamps.

2. Description of Related Art

Conventionally, decorative bulb assemblies are generally transported and sold in a form housed in packaging paper boxes. Upon packaging, paper or synthetic resin frames have been used as auxiliary packaging means for neatly housing the assemblies within the box with fixing a plurality of midget lamps in aligned fashion and neatly receiving power cable.

Japanese Examined Utility Model Publication (Kokoku) No. Heisei 5-26058 and Japanese Examined Utility Model Publication No. Heisei 5-26059 disclose a package frames, in which a recessed groove is provided for accommodating the power cable and a bulb support base is integrally extended in a horizontal direction from the upper edge of a side wall of the recessed groove. Bulb engaging hooks are provided at the base portion of the bulb supporting base for fixedly supporting the bulbs on the support base. Also, an auxiliary plate in contact with the inner peripheral wall of a package box is provided at the tip end of the bulb support base. The package frame, on which the decorative midget lamp assembly is set, is housed in the package box for transportation and delivery.

French patent No. 2,006,304 discloses a packaging box with a supporting flame, in which a string of decorative midget lamps are visibly discovered at one end in the box for confirming amount of the lamps, and the other parts including sockets and a power cable are covered under a ceiling plate at another portion therein.

U.S. Pat. No. 5,168,999 discloses a packaging holder with a tray, in which two strings of decorative midget lamps are outwardly arranged respectively at the left and right sides thereof, the other parts including sockets and a power cable are collected on a center portion thereof, for minimizing the coiling of the cable wire, and for allowing ease of testing the light strings by a potential buyer at a retail establishment.

Italian patent No. 463,668 teaches an arrangement of glass bulbs such as medical ampules in which heads of the bulbs are more slender than bottoms thereof, where the thick bottoms are dispersed to both sides in the box, and the slender heads are collected at a center portion therein, thereby providing an efficient layout.

Conventionally, it has been beneficial to prevent the tumbling of stacks, to avoid breakage of a holder for decorative midget lamp assemblies, and it has been a further object to provide that a consumer can take the midget lamp assemblies out from the holder or box to ornament it on a tree or other structures.

However, people who live in large cities often have limited living space, and have no room for a tree. Nevertheless, they may still want to display a midget lamp assembly on a wall or a desk so that they can enjoy the fantastic display of lights.

SUMMARY OF THE INVENTION

Therefore, it is a first object of the present invention to provide a holder for displaying a decorative midget lamp assembly which can display a random twinkling and flickering of lights.

A second object of the present invention is to provide a holder for displaying a decorative midget lamp assembly which can effectively use a cover portion to hide a majority of the power cable.

A third object of the present invention is to provide a holder for packaging a decorative midget lamp assembly which can also ornament it on a tree or other structure after removing same from a holder.

In order to accomplish the above-mentioned objects, according to one aspect of the invention, a combined holder for displaying and packaging a midget light source assembly, said combined holder comprises:

a central stage zone in which a plurality of midget light sources are concentratively arranged in double strings; and a pair of cover portions being placed at an upper portion and a lower portion of said central stage zone, said portions in which a power cable connecting said plurality of midget light source in series, and connecting parts thereof are received with division in half amount each.

Said combined holder for displaying and packaging a decorative midget lamp assembly including a plurality of midget lamps, and a power cable connecting said midget lamps in series via connecting parts, said holder may further comprise:

a first power cable receptacle space defined by a first ceiling plate for covering a half amount of said power cable, a first side wall provided at a side end of said first ceiling plate, a string of first holes provided through said first side wall for projecting said midget lamps respectively, and a string of first grips depending from the lower surface of said first ceiling plate for gripping said connecting parts respectively;

a second power cable receptacle space defined by a second ceiling plate covering another half amount of said power cable, a second side wall provided at a side end of said second ceiling plate, a string of second holes provided through said second side wall for projecting said midget lamps respectively, and a string of second grips for gripping said connecting parts respectively;

said first and second ceiling plates being formed into curved surfaces gradually descending toward respective outer ends;

a midget lamps display space defined by said side walls, and a bottom plate connecting between lower ends of said side walls, said midget lamps therein being alternately arranged each in double strings including one being formed by a half amount of said midget lamps projecting from said first holes and another being formed by another half amount of said midget lamps projecting from said second holes;

a transparent film covering on upper surfaces of said first and second ceiling plates including said midget lamps display space; and a board covering on lower surfaces of said bottom plate including said first and second power cable receptacle spaces.

Said board may further form with a hanging hole to be hanged in a hook.

Said midget lamps display space may form in zigzag shaped configuration.

Said holder may form in a rectangularparallelpiped body or a cylindrical body having elliptical cross section.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

Figure 1:
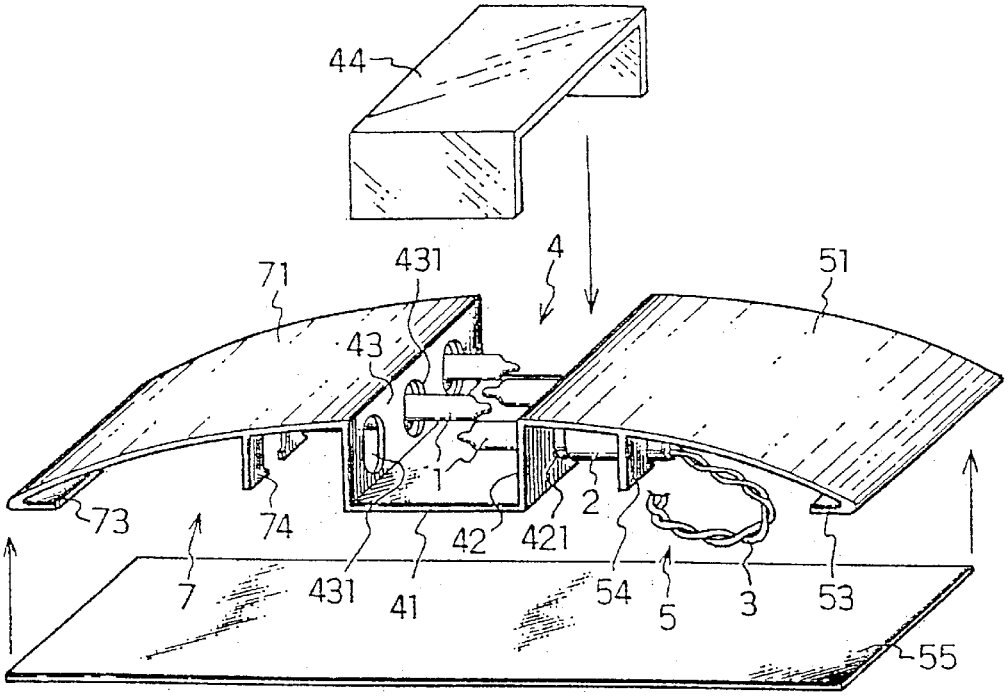
FIG. 1 is a perspective view of an embodiment of the combined holder for displaying and packaging a decorative midget lamp assembly according to the invention.

The present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to not unnecessarily obscure the present invention.

A decorative midget lamp assembly includes a plurality of midget lamps 1, 1, . . . and a power cable 3, on which the midget lamps are connected in series via sockets or connecting parts 2. Upon use of such a decorative midget lamp assembly, a large number of midget lamps 1, 1, . . . are leading characters (bright) and the power cable 3 including the socket or the connecting parts 2 are bi-player (bark) for making the leading characters active. Also, in view of the overall decorative midget lamp assembly, the proportion of respective portions are that the midget lamps 1, 1, . . . are 10 to 20% and remaining 80 to 90% is the power cable 3.

In the present invention, 10 to 20% of the midget lamps as leading characters of the decorative midget lamp assembly are packed to be externally visible upon transportation, display, sale and so forth, and 80 to 90% of the power cable 3 with the sockets or the connecting parts 2 are packed to be enclosed within the internal space and thus hidden from the external sight. Thus, the package of the decorative midget lamp assembly according to the present invention may reflect the feeling in use upon transportation, display, sale and so forth to effectively excite the consumers.

As shown in FIG. 1, the basic configuration of a holder decorative midget lamp assembly package includes a midget lamps display space or stage zone 4 and a pair of power cable receptacle spaces 5, 7. The portion of the midget lamps 1, 1, . . . are received within the midget lamps display space 4 which is opened upwardly. On the other hand, the power cable 3 together with the sockets or the connecting parts 2 are retained in receptacle portions 5, 7, upper portions of which are closed.

In FIG. 1, the midget lamps display space 4 is defined by a bottom plate 41 and first and second side walls 42 and 43. Through the first side wall 42, a plurality of holes 421 are formed in alignment. Through respective holes 421, the midget lamps 1, 1, . . . are inserted into the midget lamp display space 4 from the side of the receptacle space 5. Therefore, the midget lamps 1, 1, . . . are externally visibly arranged in the midget lamp display space 4.

In FIG. 1, the upper portion closed power cable receptacle space 5 is defined by the first side wall 42, a ceiling plate 51 extending horizontally from the upper end of the side wall 42. A plurality of grips 54 depend from the lower surface of the ceiling plate 51 and are aligned at a position in the vicinity of the aligned first holes 421. Each grip 54 fixedly holds the socket or connecting parts 2 corresponding to each midget lamp 1. Thus, the midget lamps 1, 1, . . . are generally fixed. Also, the power cable is held within the receptacle space 5.

In the upper surface of the midget lamps display space 4, a transparent cover 44 having a complimentary configuration to the display space 4 and the corresponding side thereof are engaged. By engaging the cover 44, the cover 44 and the ceiling plate 51 in the receptacle space 5 are located on the same plane. Accordingly, the upper surface of the decorative midget lamp assembly shown in FIG. 1 can be consolidated and uniformly covered satisfactory for protecting inside.

On the lower surface of the holder shown in FIG. 1, a lower cover 55 having the configuration and the size for at least covering the receptacle spaces 5, 7 is fitted to close the lower opening portion of the receptacle space 5 and 7. Thus, the power cable 3 together with the sockets or the connecting parts 2 received in the receptacle portion 5 and 7 may not escape.

The combined holder of the decorative midget lamp assembly shown in FIG. 1 is constructed to have a second power cable receptacle space 7. It should be noted that, in order to avoid confusion and to distinguish from the second power cable receptacle space 7, the power cable receptacle space 5 will be hereinafter referred to as "first power cable receptacle space" or "first receptacle space".

The upper portion closed second power cable receptacle space 7 is defined by the second side wall 43 a second ceiling plate 71 extending horizontally from the upper end of the second side wall 43. A plurality of holes 431 are formed through the second side wall 43 in alignment. Through the holes 431, a plurality of midget lamps 1, 1, . . . are inserted into the midget lamps display space 4. In the vicinity of the second side wall 43, a plurality of grips 74 depend from the lower surface of the second ceiling plate 71 of the power cable receptacle space 7. Each grip 74 is aligned with a corresponding hole 431. The grips 74 engage and hold the sockets or connecting portions 2 for firmly fixing the midget lamps 1,1, . . . . At the same time, the power cable 3 is received within the receptacle space.

On the lower surface of the holder shown in FIG. 1, a lower cover 55 having the configuration and the size for at least covering the first and second receptacle spaces 5 and 7 is fitted to close the lower opening portion of the first and second receptacle spaces 5 and 7. Thus, the power cable 3 together with the sockets or the connecting parts 2 received in the first and second receptacle spaces 5 and 7 may not escape.

FIGS. 2 to 6, and FIGS. 8 to 9, are modifications of the foregoing embodiments of the holder for packaging the decorative bulb assemblies according to the present invention.

Figure 2:
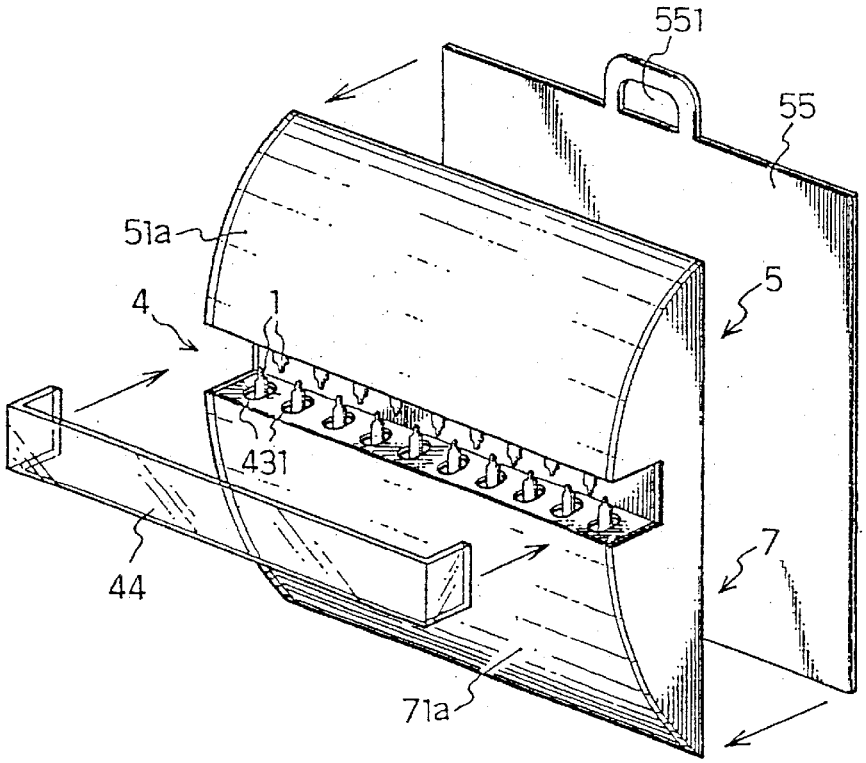
FIG. 2 is a perspective view showing an embodiment, in which the holder shown in FIG. 1 is shaped into a package form adapted to hanging display.

FIG. 2 is a modification of the holder shown in FIG. 1. In the shown modification, a hanging hole 551 is formed at the upper edge portion of the lower cover 55 of the barrel shaped holder for permitting hanging display in a shop and a consumer's house.

Figure 3:
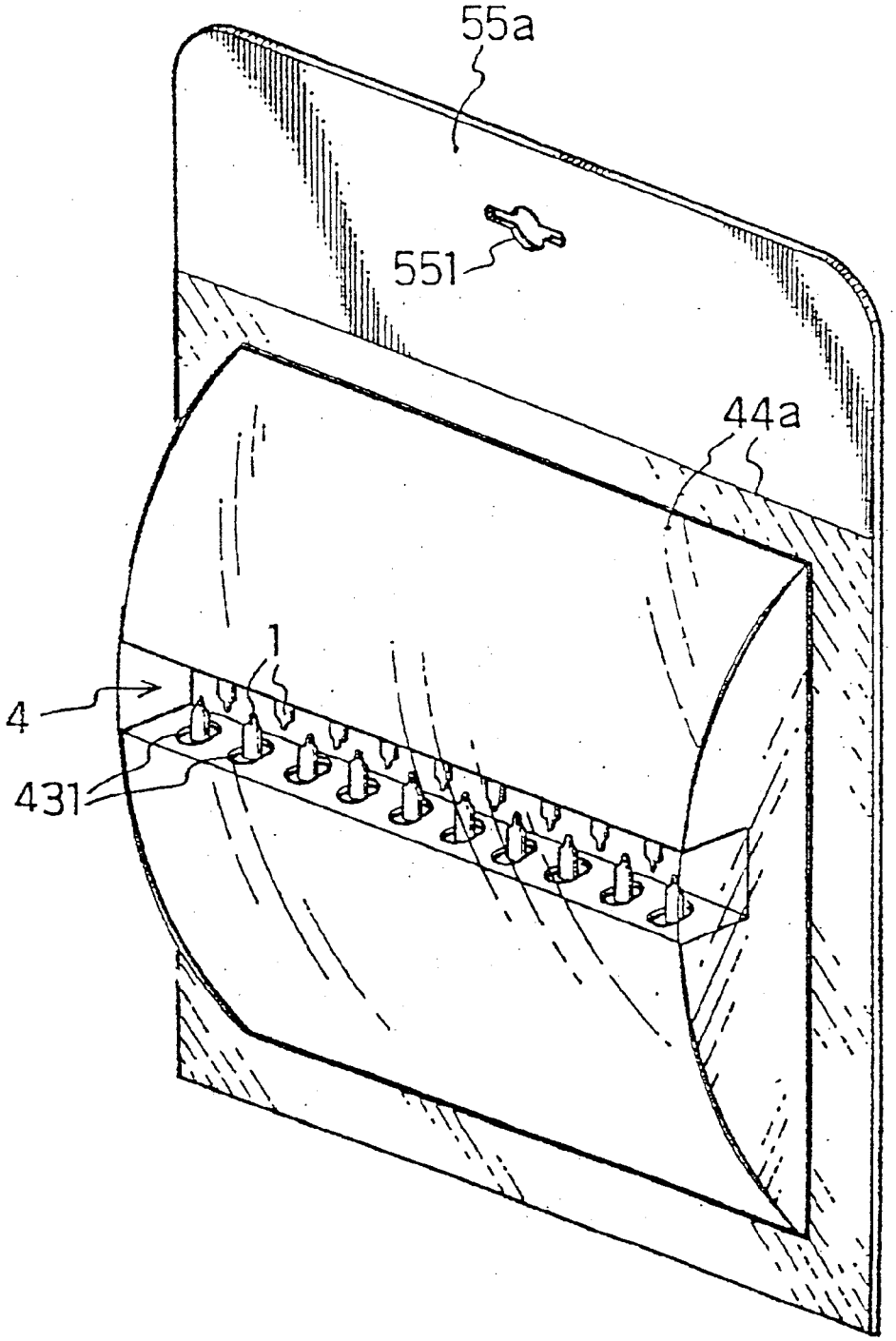
FIG. 3 is a perspective view showing an embodiment, in which the holder shown in FIG. 1 is formed by way of vacuum molding into a package form adapted to hanging display.

FIG. 3 is a modification of the barrel shaped holder of FIG. 2. In the shown modification, the transparent cover 44 covering the midget lamps display space 4 in FIG. 2 is omitted, and a laminated film 44*a* covering overall upper or outer surface is provided. In this case, the lower cover 55 is formed of a board member 55*a* adapted for the application of the laminated film. The shown holder is produced by a vacuum molding process.

Figure 4:
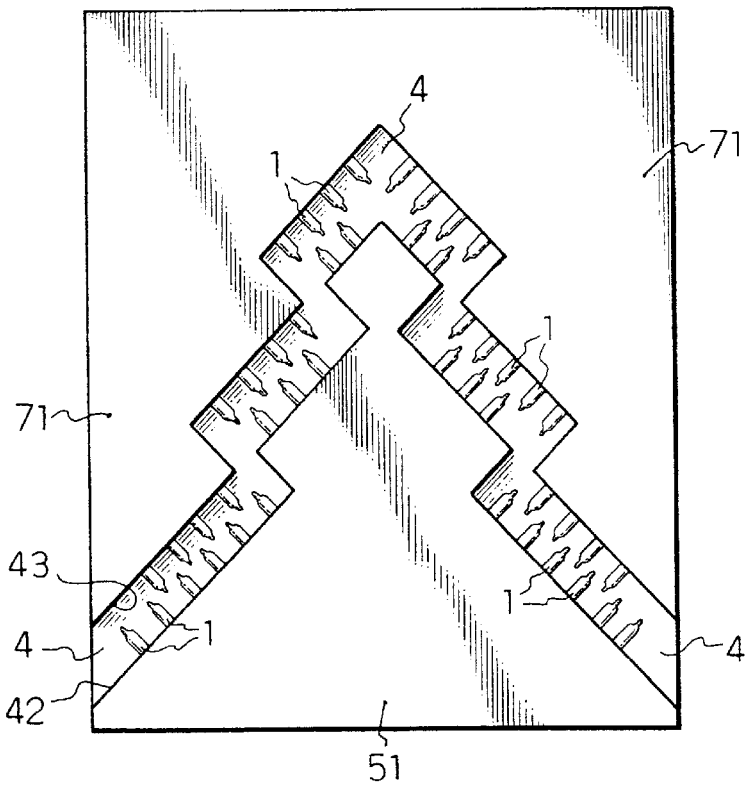
FIG. 4 is a plan view showing an embodiment of the combined holder according to the invention, in which the display space is defined in bending manner on a common plane.

FIG. 4 is a modification of the holder of FIG. 1, in which the first midget lamp display space 4 is formed into none-straight, i.e. a zigzag shaped configuration. On both sides of the midget lamps display space 4, first and second ceiling plates 51 and 71 of the first and second power cable receptacle spaces 5 and 7 are defined. If desired, the surfaces of the first and/or second ceiling plates 51 and 71 are colored. For example, in the shown case, the midget lamps display space 4 may be imaginable as a flash of lightning or a Christmas tree by coloring the surfaces of the first and second ceiling plates 51 and 71.

Figure 5:
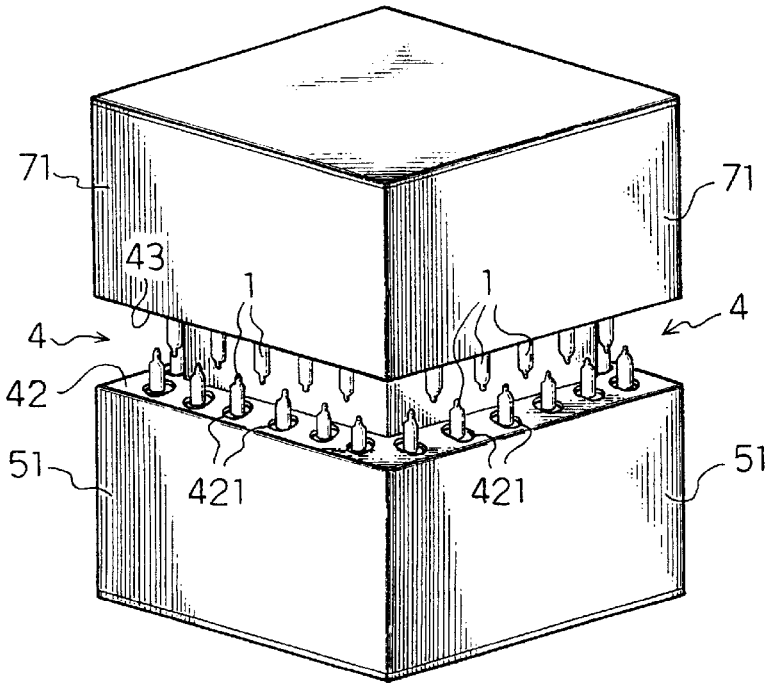
FIG. 5 is a plan view of the embodiment of the combined holder according to the invention, in which the display space is defined in three-dimensionally mode.

FIG. 5 shows a modification of the holder shown in FIG. 1. In this modification, the first midget lamps display space 4 is defined around the periphery of the rectangularparallelpiped configuration of holder. In this case, the first and second ceiling plates 51 and 71 of the first and second power cable receptacle spaces 5 and 7 are arranged in vertical alignment.

Figure 6:
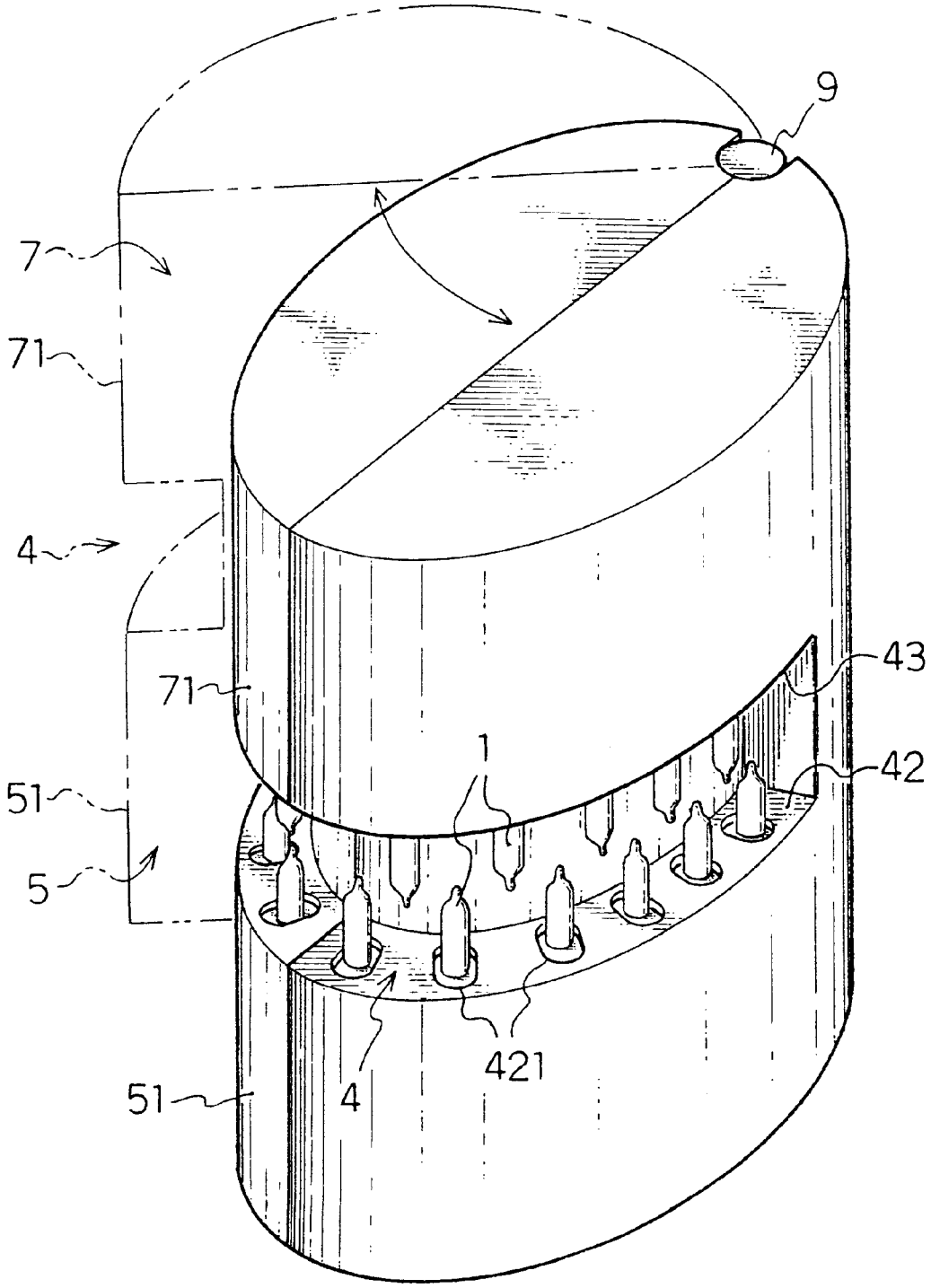
FIG. 6 is a plan view showing the embodiment of the combined holder according to the invention, in which the display space is defined in three-dimensional elliptic plane, and the holder is hinged for opening and closing.

FIG. 6 shows a modification of the holder of FIG. 1, in which the first midget lamps display space 4 is built in a cross sectionally elliptic cylindrical body. The ceiling plates 51 and 71 of the first and second power cable receptacle spaces 5 and 7 are arranged at upper and lower sides of the midget lamps display space 4. The shown cylindrical body of the elliptic cross section is constituted of two halves pivotally connected to each other via a pivot 9 for pivoting between the closed position as illustrated by the solid line and the open position illustrated by the two-dotted line.

Figure 7:
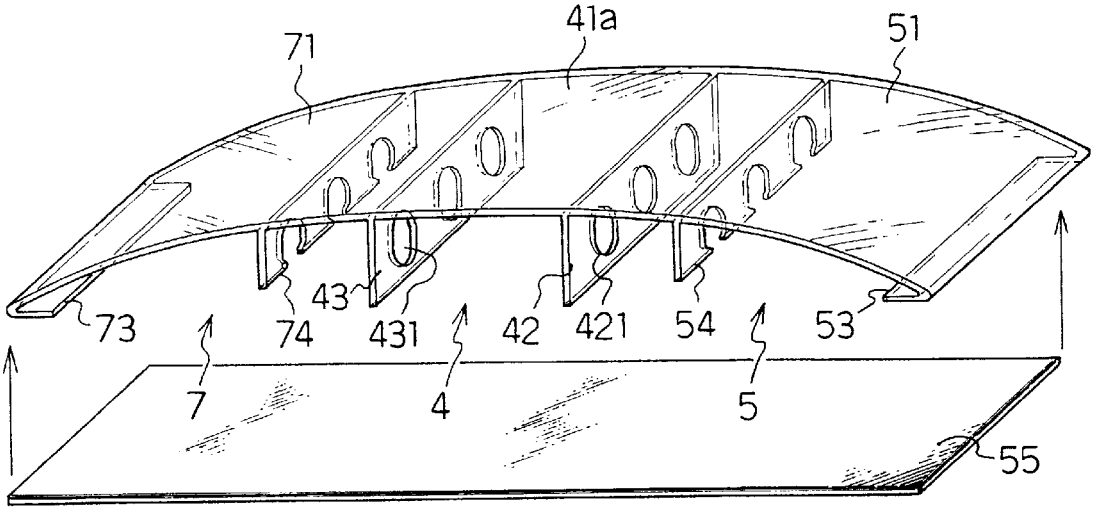
FIG. 7 is a perspective view showing the embodiment of the holder of FIG. 1, in which a bottom plate is neglected and a transparent upper plate is extended from both ceiling plates is provided in replace thereof.

FIG. 7 shows a modification of the barrel shaped holder of FIG. 1. In the shown embodiment, the first bottom plate 41 of the first midget lamps display space 4 is omitted, and in place thereof, a third ceiling plate 41*a* is provided continuously with the ceiling plates 51 and 71*a* with curved surfaces. Also, at least the ceiling plate 41*a* is formed of a transparent body. In the shown embodiment, except for the lower cover, all components are integrally molded with an acryl resin.

Figure 8:
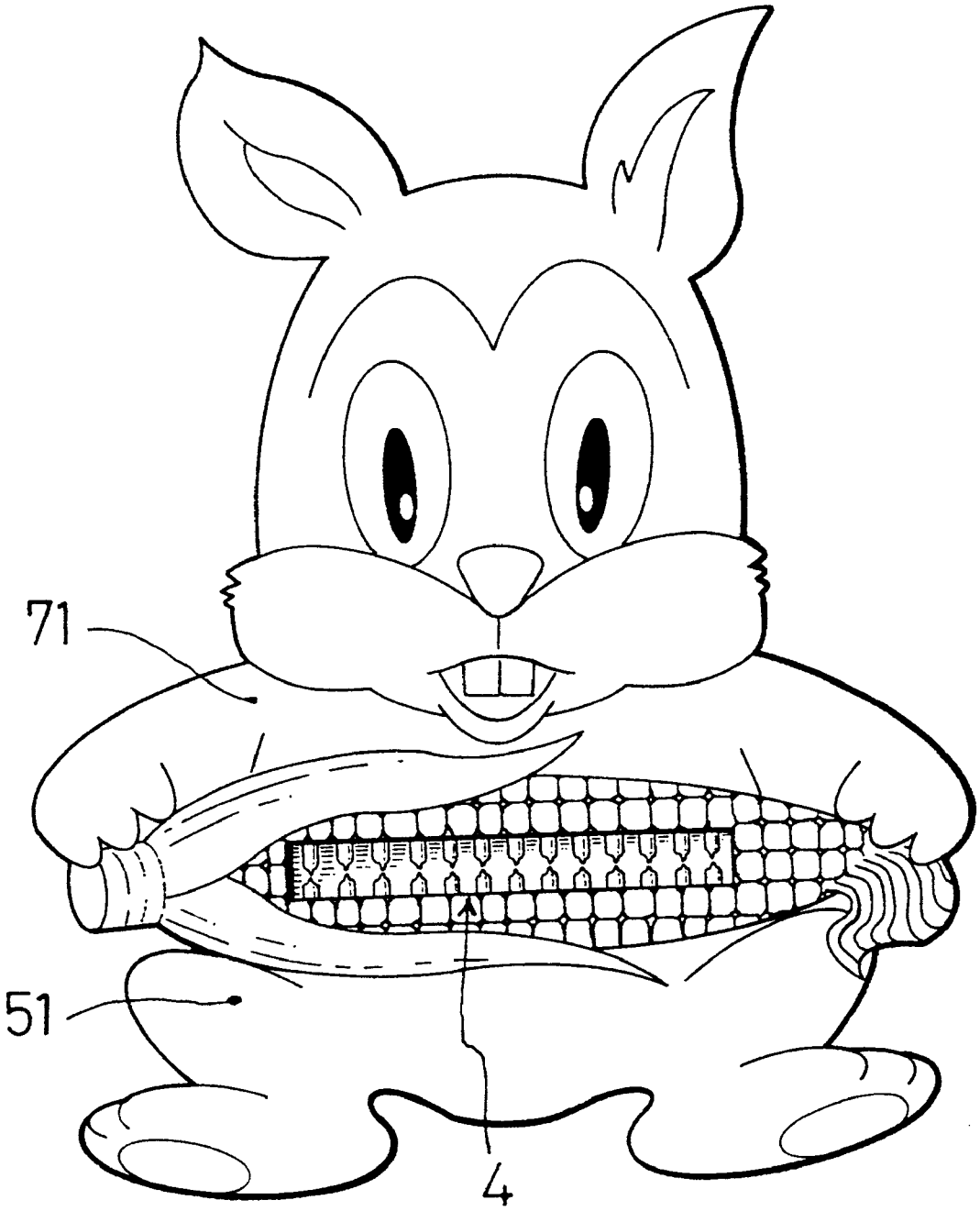
FIG. 8 is a plan view showing an embodiment of the combined holder according to the invention, in which the display space is defined in an illustrated fanciful character.

FIG. 8 shows a modification of the holder of FIG. 1. In this modification, the first midget lamp display space 4 is defined between the first and second ceiling plates 51 and 71 of the first and second power cable receptacle spaces 5 and 7. A fanciful character is illustrated on the surface of the first and second ceiling plates 51 and 71.

Figure 9:
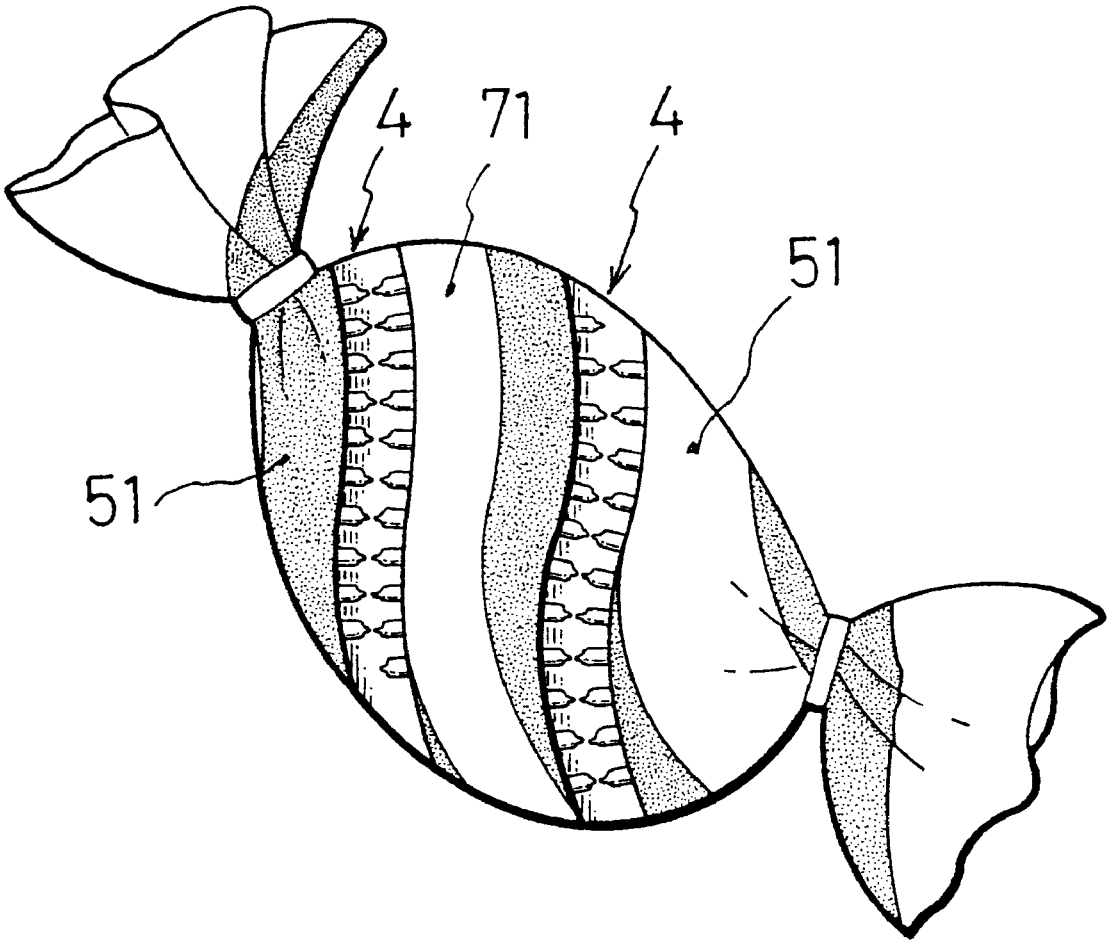
FIG. 9 is a plan view showing an embodiment of the combined holder according to the invention, in which the two display spaces are defined in an illustrated bag.

FIG. 9 shows a modification of the holder of FIG. 1. In this modification, two of the first midget lamp display spaces 4 and 4 are respectively defined between the first and second ceiling plates 51 and 71 of the first and second power cable receptacle space 5 and 7. A bag is illustrated on the surface of the first and second ceiling plates 51 and 71.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as being limited to the specific embodiments set out above but to include all possible embodiments which can be embodied within a scope encompassed and equivalents thereof with respect to the appended claims.

What is claimed is:

1. A combined holder for displaying and packaging a decorative midget lamp assembly including a plurality of midget lamps (1), and a power cable (3) connecting said midget lamps (1) in series via connecting parts (2), said holder comprising:

a first power cable receptacle space (5) defined by a first ceiling plate (51) for covering a portion of said power cable (3), a first side wall (42) provided at a side end of said first ceiling plate (51), a string of first holes (421) provided through said first side wall (42) for projecting said midget lamps (1) respectively, and a string of first grips (54) depending from the lower surface of said first ceiling plate (51) for gripping said connecting parts (2) respectively;

a second power cable receptacle space (7) defined by a secondceiling plate (71) covering another portion of said power cable (3), a second side wall (43) provided at a side end of said second ceiling plate (71), a string of second holes (431) provided through said second side wall (43) for projecting said midget lamps (1) respectively, and a string of second grips (74) for gripping said connecting parts (2) respectively:

said first and second ceiling plates (51, 71) being formed into curved surfaces gradually descending toward respective outer ends;

a midget lamps display space (4) defined by said side walls (42, 43), and a bottom plate (41) connecting between lower ends of said side walls (42, 43), said midget lamps (1) therein being alternately arranged each in double strings including one being formed by some of said midget lamps (1) projecting from said first holes (421) and another being formed by some of said midget lamps (1) projecting from said second holes (431);

a transparent film (55*a*) covering upper surfaces of said first and second ceiling plates (51, 71) including said midget lamps display space (4); and a board (55) covering lower surfaces of said bottom plate (41) including said first and second power cable receptacle spaces (5, 7).

2. A combined holder as set forth in claim 1, wherein said board (55) is further formed with a hanging hole (551) to be hanged on a hook.

3. A combined holder as set forth in claim 1, wherein said midget lamps display space (4) is formed in zigzag shaped configuration.

4. A combined holder as set forth in claim 1, wherein said holder is formed in a rectangularparallelpiped body.

5. A combined holder as set forth in claim 1, wherein said holder is formed in a cylindrical body having elliptical cross section.

* * * * *